United States Patent [19]

Van Aken et al.

[11] Patent Number: 4,799,053

[45] Date of Patent: Jan. 17, 1989

[54] COLOR PALETTE HAVING MULTIPLEXED COLOR LOOK UP TABLE LOADING

[75] Inventors: Jerry Van Aken, Sugarland; Karl Guttag, Houston, both of Tex.

[73] Assignee: Texas Instruments Incorporated, Dallas, Tex.

[21] Appl. No.: 856,736

[22] Filed: Apr. 28, 1986

[51] Int. Cl.[4] ..... G09G 1/16

[52] U.S. Cl. ..... 340/703; 340/734; 340/799

[58] Field of Search ..... 340/703, 734, 750, 798, 340/799

[56] References Cited

U.S. PATENT DOCUMENTS 4,258,361 3/1981 Hydes et al. ..... 340/734
4,481,594 11/1984 Staggs et al. ..... 340/703
4,580,134 4/1986 Campbell et al. ..... 340/703

*Primary Examiner*—Marshall M. Curtis

*Attorney, Agent, or Firm*—Thomas W. DeMond; Melvin Sharp; N. Rhys Merrett

[57] ABSTRACT

The present invention loads color registers of a color look up table in a color palette and recalls color data words from the color registers using only a single set of address and data channels. The color palette operates in two modes. In a normal mode one color code from a stream of pixel color codes received from a pixel map memory is employed to select one of the color registers. These color registers store color data words which define colors. A color data word stored in a selected color register is recalled and employed to control the color of a pixel on a raster scan video display. In a color look up table load mode, a predetermined number of the pixel color codes are loaded into the color look up table in a predetermined sequence, thereby defining a new set of colors. This technique multiplexes the existing data and control lines from the memory to the color palette for the two modes.

22 Claims, 9 Drawing Sheets

| | | | | | | | | | | | | | | | |
|---|---|---|---|---|---|---|---|---|---|---|---|---|---|---|---|
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |
| R | R | R | R | R | R | R | R | R | R | R | R | R | R | R | R |

*Fig. 12*

| | | | | | | | | | | | | | | | |
|---|---|---|---|---|---|---|---|---|---|---|---|---|---|---|---|
| 1 | R | R | R | R | R | 2 | R | 1 | R | R | R | R | R | R | R |
| 1 | R | R | R | R | 2 | R | R | R | 1 | R | R | R | R | R | R |
| 1 | R | R | 2 | R | R | R | R | R | R | 1 | R | R | R | R | R |
| 1 | R | 2 | R | R | R | R | R | R | R | R | 1 | R | R | R | R |
| 1 | R | R | R | 2 | R | R | R | R | R | R | R | 1 | R | R | R |
| 1 | R | R | R | R | 2 | R | R | R | R | R | 1 | R | R | R | R |
| 1 | R | R | 3 | R | R | R | 2 | R | R | 3 | R | R | R | 1 | R |
| 1 | R | R | 3 | R | R | R | R | 2 | 3 | R | R | R | R | 1 | R |
| 1 | R | R | 3 | R | R | 1 | R | R | R | R | 3 | R | R | 1 | R |
| 1 | R | R | 3 | R | R | 1 | R | R | R | R | 3 | R | R | 1 | R |

*Fig. 13*

| | | | | | | | | | | | | | | | |
|---|---|---|---|---|---|---|---|---|---|---|---|---|---|---|---|
| 1 | 1 | 1 | 1 | 1 | 1 | 2 | 2 | 1 | 1 | 1 | 1 | 1 | 1 | 1 | 1 |
| 1 | 1 | 1 | 1 | 1 | 2 | 2 | 2 | 2 | 1 | 1 | 1 | 1 | 1 | 1 | 1 |
| 1 | 1 | 1 | 2 | 2 | 2 | 2 | 2 | 2 | 2 | 1 | 1 | 1 | 1 | 1 | 1 |
| 1 | 1 | 2 | 2 | 2 | 2 | 2 | 2 | 2 | 2 | 2 | 1 | 1 | 1 | 1 | 1 |
| 1 | 1 | 1 | 1 | 2 | 2 | 2 | 2 | 2 | 2 | 2 | 2 | 1 | 1 | 1 | 1 |
| 1 | 1 | 1 | 1 | 1 | 2 | 2 | 2 | 2 | 2 | 2 | 1 | 1 | 1 | 1 | 1 |
| 1 | 1 | 1 | 3 | 3 | 3 | 3 | 2 | 2 | 2 | 3 | 3 | 3 | 3 | 1 | 1 |
| 1 | 1 | 1 | 3 | 3 | 3 | 3 | 3 | 2 | 3 | 3 | 3 | 3 | 3 | 1 | 1 |
| 1 | 1 | 1 | 3 | 3 | 3 | 1 | 1 | 1 | 1 | 1 | 3 | 3 | 3 | 1 | 1 |
| 1 | 1 | 1 | 3 | 3 | 3 | 1 | 1 | 1 | 1 | 1 | 3 | 3 | 3 | 1 | 1 |

COLOR PALETTE HAVING MULTIPLEXED COLOR LOOK UP TABLE LOADING

BACKGROUND OF THE INVENTION

The field of the present invention is computer graphics systems and in particular computer graphics systems which use color. With the reduction in the price of dynamic random access memories it has become economical to provide a bit map or pixel map memory for computer graphics systems. In such a bit map or pixel map memory a color code is stored in a memory location corresponding to each pixel to be displayed. A video system is provided which recalls the color codes for each pixel and generates a raster scan video signal corresponding to the recalled color codes. Thus, the data stored in the memory determines the display by determining the color generated for each picture element of the display.

The requirement for a natural looking display and the minimization of required memory are conflicting. In order to have a natural looking display it is necessary to have a large number of available colors. This requires a large number of bits for each pixel in order to specify the particular color from among a large number of possibilities. However, the provision of a large number of bits per pixel requires a large amount of memory for storage. Since a number of bits must be provided for each pixel element in the display, even a modest sized display would require a large memory. Thus it is advantageous to provide some method to reduce the amount of memory needed to store the display while retaining the capability of choosing among a large number of colors.

The provision of a color palette enables a compromise between these conflicting requirements. The color codes stored for each pixel have a limited number of bits, thereby reducing the memory requirements. The color codes are employed to select one of a number of color registers. These color registers each store color data words which are longer than the pixel color codes. The number of such color registers provided in the color palette is equal to the number of selections provided by the pixel color codes.

This technique has advantages and disadvantages. Such a color palette provides a reduced memory requirement by limiting the number of bits in the pixel color codes. Because the color data words stored in the color registers are longer than the pixel color codes, each color data word can select from a larger number of possible colors. This technique thus enables the capability of specifying a color from among a set of colors much larger than can be specified by the pixel color code alone. The disadvantage is that the number of colors that can be specified at any one time is limited by the size of the pixel color code. Because the number of color registers is less than the total number of colors which can be selected by the longer color words, the color palette can select only a subset of the set of colors selectable by the longer color data words. This disadvantage can by partially overcome by enabling the color registers of the color palette to be changed during display. Thus while only a limited number of colors can be displayed at one time, the possible colors can be expanded by loading several alternate selections of color data words within the color registers as required during display.

Due to the advantages of this color palette technique, any improvements in its implementation would be advantageous in computer color graphics systems.

SUMMARY OF THE INVENTION

The present invention is an improvement in the manner of loading the color look up table of a color palette such as described above. In accordance with the present invention the data and control lines used in the normal operation of the present invention are multiplexed to permit loading of the color look up table.

The color palette operates in two modes. In a normal mode the stream of pixel color codes received from the pixel map memory is employed to sequentially select one of the set of color registers. These color registers store color data words having more bits than the pixel color codes. The color data word stored in the selected color register is recalled and employed to control the current color of a raster scan video display. In a color look up table load mode a predetermined number of the pixel color codes are loaded into the color look up table in a predetermined sequence, thereby defining a new set of colors. This technique multiplexes the existing data and control lines from the memory to the color palette for the two modes.

In a first embodiment of the present invention the color look up table is loaded once per video frame. Mode control signals applied to the color palette select this mode. During the vertical blanking interval prior to each video frame the color palette enters the color look up table mode and loads the color registers. In this embodiment the video outputs are preferably blanked during an entire initial nondisplayed video line during which the color look up table load operation takes place. The video outputs operate normally for other video lines within the frame.

In a second embodiment of the present invention the color look up table is loaded once for each selected video frame. When a video frame is selected, the loading operation takes place as noted above in the first embodiment. The color look up operation takes place during an initial nondisplayed video line during which time the video outputs are blanked. During frames which are not selected, no color look up table load operation occurs. In this event the video outputs operate normally for all video lines including the initial line.

In a third embodiment of the present invention the color look up table is loaded once per video line. In this embodiment an initial interval during each video line is taken up by the color look up table load operation. During this initial interval the video outputs are blanked. The rest of each video line the video outputs operate normally. This embodiment enables the greatest number of possible colors to be displayed within a single video frame. This technique does absorb a greater proportion of the video bandwidth than the earlier described embodiments, thereby limiting the size and refresh rate of the video display.

In accordance with the preferred embodiment of the present invention the mode control signals applied to the color palette are readily available video signals. In the preferred embodiment the color palette receives two mode control signals. The first of these mode control signals is the inverse of the blanking signal. This first mode control signal serves to indicate the various frame and line intervals. The second mode control signal is either the inverse of the vertical synchronization signal or a constant logic level dependent upon the mode selected. It can be seem that these signals would be readily available in a video system. The construction of the color palette to employ these video signals enhances the ease of use of the device by minimizing the requirement for special circuits for mode selection.

BRIEF DESCRIPTION OF THE DRAWINGS

These and other aspects of the present invention will be further understood from the explanation below in conjunction with the drawings in which:

FIG. 12 illustrates a portion of the pixel map memory in which each pixel color code is the repeat code;

FIG. 13 illustrates a portion of the pixel map memory in which further non-repeat pixel color codes have been added;

DETAILED DESCRIPTION OF THE PREFERRED EMBODIMENT

Figure 1:
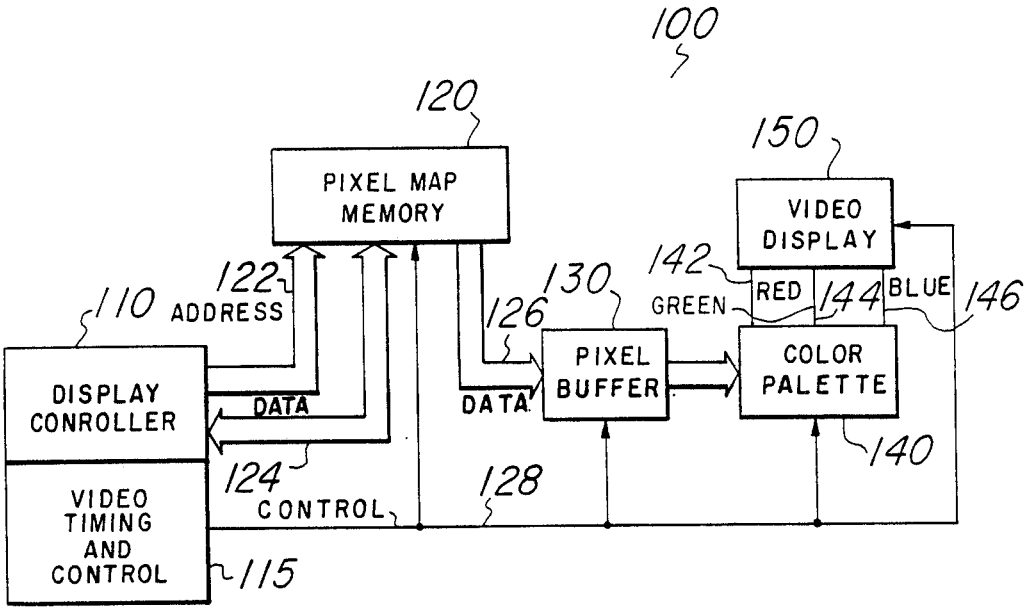
FIG. 1 illustrates a video display system in which the present invention can be employed.

FIG. 1 illustrates video system 100. Video system 100 includes the major parts necessary for practicing the present invention. Video system 100 includes display memory controller 110, video timing and control circuit 115, pixel map memory 120, pixel buffer 130, color palette 140 and video display 150. Display controller 110 is coupled to pixel map memory 120 via address bus 122 and data bust 124. Video timing and control circuit 115 is also connected to pixel map memory 120 via control bus 128. Pixel map memory 120 includes a plurality of memory locations selectable via address bus 122. Each address location within pixel map memory 120 includes data corresponding to an individual pixel or pixels of a visual image to be displayed via video display 150. Each pixel color code stored within pixel map memory 120 includes data corresponding to the particular video attributes to be displayed at the corresponding pixel location of video display 150. These video attributes include the color and intensity of the particular pixel.

In accordance with normal operation of video system 100, display controller 110, video timing and control circuit 115 and pixel map memory 120 cooperate to generate a stream of data which enables generation of the video signals to video display 150. Display controller 110 generates sequential addresses on address bus 122 for application to pixel map memory 120. Video timing and control circuit 115 generates corresponding signals on control bust 128 for application to pixel map memory 120. These in particular are timing and mode control signals. In accordance with the normal mode of video system 100, pixel color code data is recalled from pixel map memory 120 and therefore video timing and control circuit 115 applies a read memory signal to this memory via control bus 128. The sequence of addresses generated by display controller 110 and applied to pixel map memory 120 recalls pixel color codes from pixel map memory 120 in an order corresponding to the order of display on video display 150. In accordance with the normal conditions, video display 150 is a raster scan display in which pixels are scanned from left to right and top to bottom. The sequence of addresses generated by display controller 110 on address bus 122 ensures that pixel color codes are recalled from pixel map memory 120 in this prescribed order.

This stream of recalled pixel color codes appears on data bus 126 and is supplied to pixel buffer 130. Pixel buffer 130 is controlled by video timing and control circuit 115 via control bus 128 and serves to temporarily store recalled pixel color codes from pixel map memory 120 for application to color palette 140 via bus 135. Color palette 140 is also under the control of video timing and control circuit 115 via control bus 128. This control chiefly preserves the timing of the recall of pixel color codes from pixel map memory 120 and the display of the corresponding pixel on video display 150. Color palette 140 receives this stream of recalled pixel color codes from pixel buffer 130 via bus 135. Color palette 140 generates video signals corresponding to these received pixel color codes. One technique for specifying the video signals is a set of three primary color signals. In the preferred embodiment illustrated in FIG. 1, these video signals includes a separate red color signal on line 142, a green color signal on line 144 and a blue color signal on line 146. These respective red, green and blue color signals are generated by color palette 140 corresponding to the received pixel color codes and corresponding to an internal color look up table further illustrated in FIG. 2. Though the preferred embodiment includes separate red, green and blue color signals, those skilled in the art would realize that the color and luminance informaton may be transmitted to the video display 150 via a single composite video signal. Video display 150 generates a visual display in accordance with the respective red, green and blue color signals received from color palette 140 and control signals received from video and timing control circuit 115 via control bus 128.

Display controller 110 is further coupled to pixel map memory 120 via data bus 124. In conjunction with video timing and control circuit 115, this data connection between display controller 110 and pixel map memory 120 enables display controller 110 to control the contents of pixel map memory 120. As should be clear from the previous discussion of video system 100, control of the contents of pixel map memory 120 controls the visual image generated by video display 150. In a typical video system such as video system 100 illustrated in FIG. 1, display controller 110 is permitted to alter the contents of pixel map memory 120. The provision of the two data busses 126 and 124 connected to pixel map memory 120 facilitates dual access. In the preferred embodiment pixel map memory 120 is constructed of dual port video random access memories. A parallel access data port, corresponding to data bus 124, enables access by display controller 110 for modification of the visual image by modification of the pixel color codes. A serial port within the video random access memories includes a long shift register which is periodically loaded from the memory array and then shifted out. The process of loading this long shift register requires only one memory access cycle but provides enough data for serial output for a period related to the length of the shift register. The outputs of these shift registers form data bus 126 which controls the display update. The use of such dual port memories for pixel map memory 120 substantially reduces contention for memory access bandwidth. The serial ports permit nearly continuous generation of data on data bus 126 for display update. On the other hand, because loading the long shift registers requires only a single memory cycle, nearly the entire memory access bandwidth is available for visual image control via data bus 124.

As will be noted below, in the preferred embodiment the pixel color codes stored within pixel map memory 120 are 4 bits long. This 4 bit pixel color code enables the color look up table within color palette 140 to include 16 entries. It is possible to provide data to color palette 140 from a 4 bit bus. However, this requires a very large data rate particularly for larger displays. In order to reduce the data rate on bus 126, this bus is formed of 8 bits. In such an event, 1 word recalled from pixel map memory 120 includes 8 bits of data, a length which corresponds to two of the 4 bit pixel color codes. In accordance with the preferred embodiment, data for two adjacent odd and even pixel color codes are stored within a single string of 8 bits of pixel map memory 120. When recalled these 2 pixel color codes are applied to pixel buffer 130 via data bus 126. In accordance with timing and control signals from video timing and control circuit 115, these two pixel color codes are applied sequentially to video palette 140 rather than in parallel as they are received. This permits the employment of 8 bit data words on data bus 126 which reduces the data rate required on the individual lines of data bus 126 while preserving the desired 4 bit pixel color codes within color palette 140.

Figure 2:
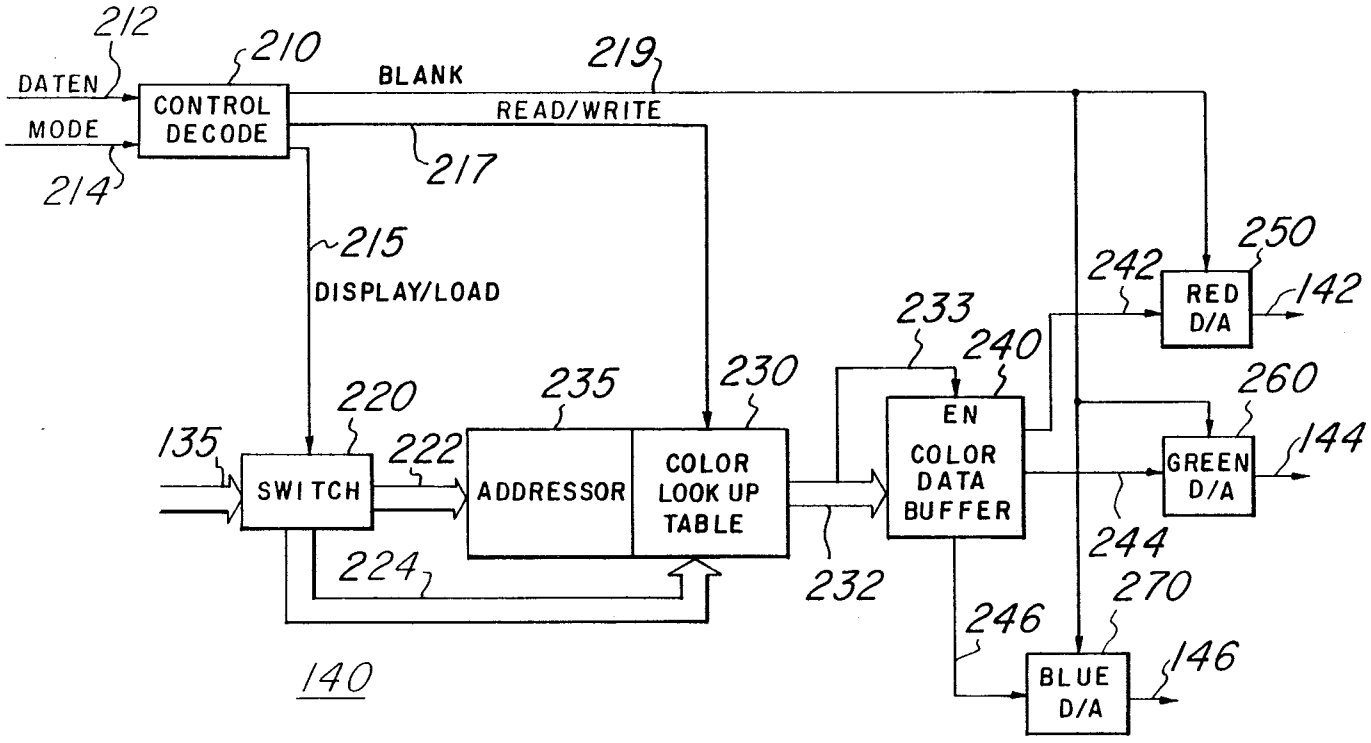
FIG. 2 illustrates further details of the color palette illustrated in FIG. 1.

FIG. 2 illustrates the details of color palette 140 illustrated in FIG. 1. Color palette 140 includes control decode 210, switch 220, color look up table 230 having an addressor 235, color data buffer 240 and 3 digital to analog converters 250, 260 and 270. Control decode circuit 210 is coupled to video timing and control circuit 115 via 2 mode control lines. DATEN line 212 and MODE line 214. Control decode circuit 210 controls the operation of the color palette in accordance with the control signals received. Control decode circuit 210 generates a display/load signal 215 which is applied to switch circuit 220. Control decode circuit 210 generates a read/write signal 217 which is applied to color look up table 230 and addressor 235. Lastly, control decode circuit 210 generates a blank signal 219 which is applied to each of the digital to analog converters 250, 260 and 270.

Switch circuit 220 is coupled to bus 135 and receives the sequential pixel color codes from pixel buffer 130 via this bus. In accordance with the display/load signal 215 received from control decode 210, switch circuit 220 applies the received pixel color codes either to addressor 235 or to color look up table 230. In accordance with the normal mode for display of visual images, switch 220 is in the display mode in which the received pixel color codes from bus 135 are applied to addressor 235. In accordance with color look up table load mode, switch circuit 220 is in the load mode in which the received pixel color codes from bus 135 are applied to color look up table 230.

Color look up table 230 operates in conjunction with addressor 235 to control the video output signal of color palette 140. In the preferred embodiment, color look up table 230 includes 16 separate memory registers for storing 16 words of color data. During a normal display operation, 4 bit pixel color codes received from switch 220 are applied to addressor 235. In accordance with the particular received pixel color code, addressor 235 selects 1 of the 16 color data registers of color look up table 230 and outputs the data stored therein. Note that 4 bits of pixel color code data can specify up to $2^4$ or 16 differing states. Therefore, color look up table 230 includes 16 color registers corresponding to the 16 possible selections from a 4 bit pixel color code.

Figure 3:
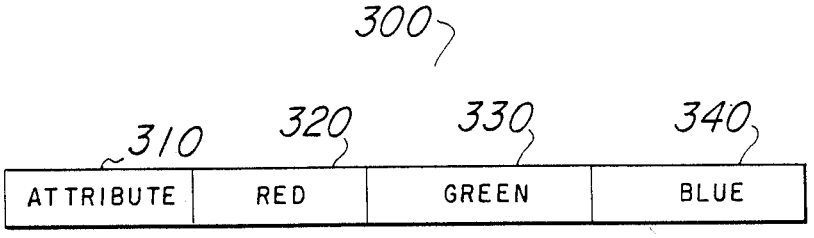
FIG. 3 illustrates the color data word stored within the color register of the color look up table illustrated in FIG. 2.

The color data word recalled from the selected color register is applied via bus 232 to color data buffer 240. In accordance with the preferred embodiment this color data word has the form illustrated at 300 in FIG. 3. This color data word includes one or more attribute bits 310, red color bits 320, green color bits 330 and blue color bits 340. The red color bits 320 are applied via lines 242 to the red digital to analog converter 250. Red digital to analog converter generates a red color signal on line 142 for application to video display 150. Green color bits 330 are applied via lines 244 to green to digital to analog converter 260. Green analog to digital converter 260 generates the green color signal on line 144 for application to video display 150. Lastly, the blue color bits 340 are applied via lines 246 to blue digital to analog converter 270 which generates the blue color signal on line 146.

As noted in FIG. 2, a separate line 233 comes from bus 232 and is applied to an enable input of color data buffer 240. In accordance with one aspect of the present invention, portions of the attribute 310 of the recalled color data word 300 may be applied to the enable input of color data buffer 240 to produce a "repeat" color. This aspect of the present invention will be further described below.

When the mode signals applied to control decode circuit 210 indicate a color look up table load mode, color palette 140 operates differently from that described above. Firstly, control decode circuit 210 applies a load signal via line 215 to switch 220. This causes the received pixel color codes on bus 135 to be applied to color look up table 230 via bus 224 rather than to addressor 235 via bus 222. In addition, control decode circuit 210 applies a write signal to both color look up table 230 and addressor 235. The received pixel color codes are then applied to the 16 color registers of color look up table 230 to load these registers. During this color table load operation, addressor 235 generates a predetermined sequence of addresses causing the received pixel color codes to be stores at predetermined locations in a fixed sequence. At the same time control decode circuit 210 generates a blank signal on line 219 which is applied to red digital to analog converter 250, green digital to analog converter 260 and blue digital to analog converter 270.

Figure 4:
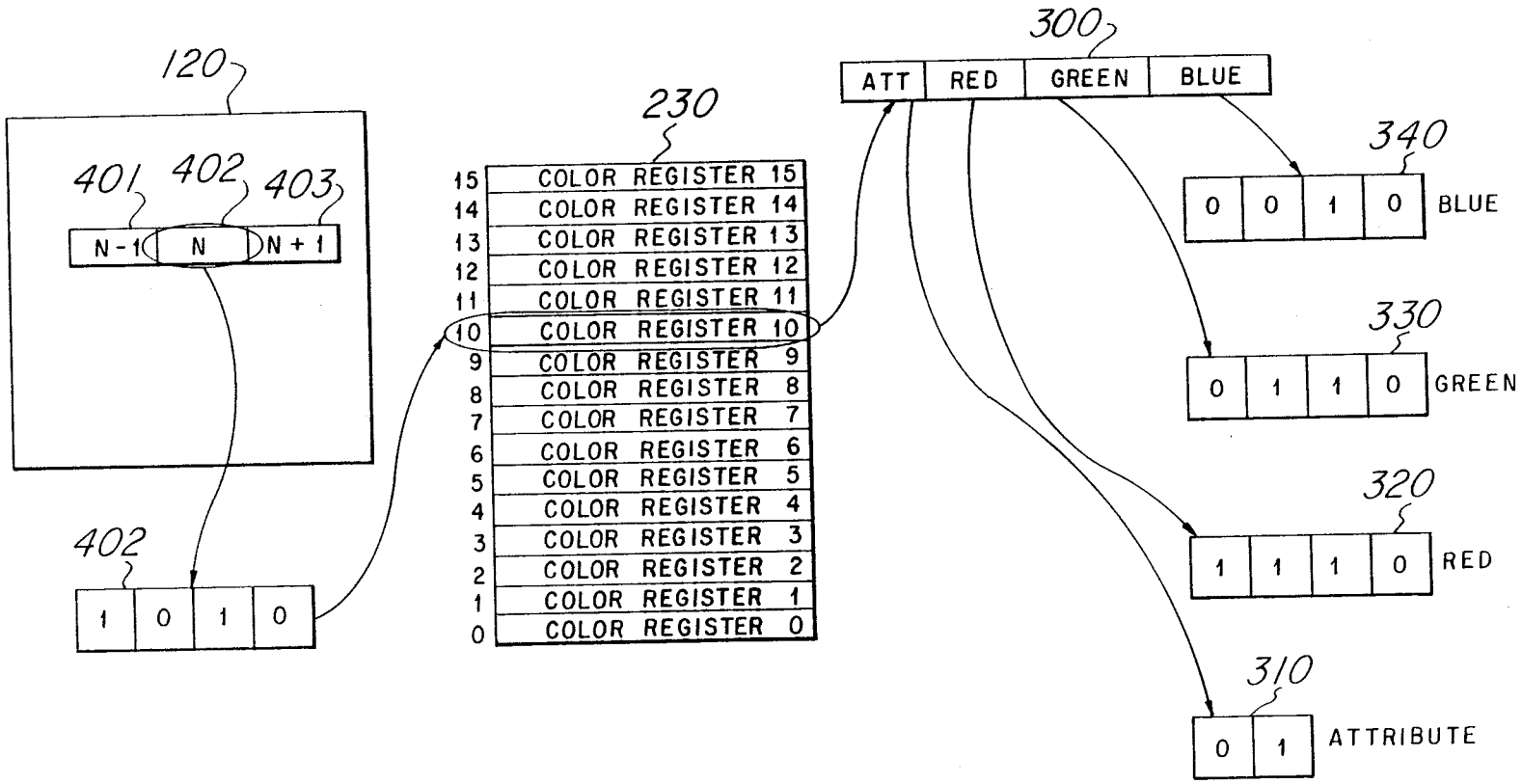
FIG. 4 illustrates schematically the data flow from the pixel map memory to the video signal generator in accordance with the normal operating mode of the color palette of the present invention.
Figure 5:
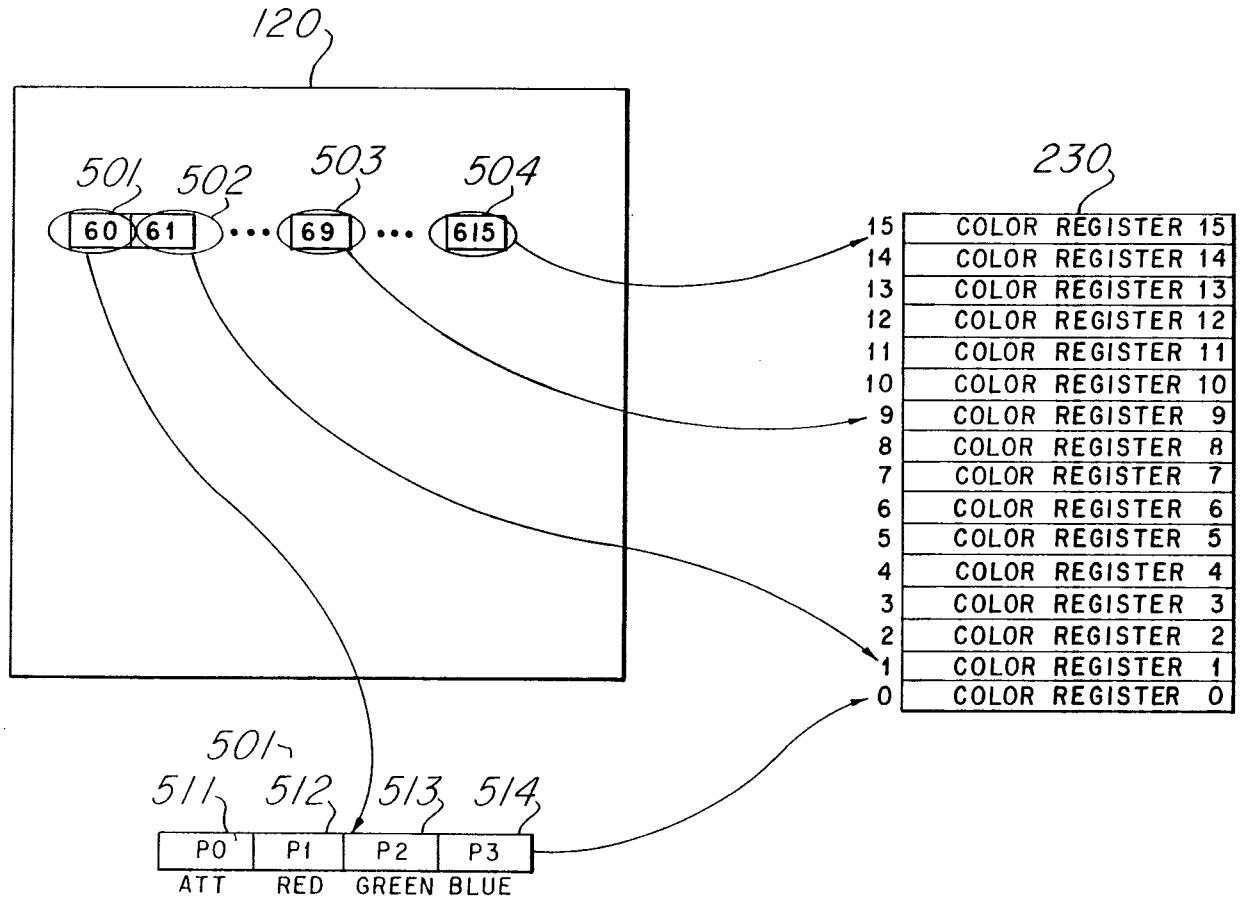
FIG. 5 illustrates schematically the data flow from the pixel map memory to the color look up table in accordance with the color look up table load mode of the present invention.

The two modes of operation of color palette 140 are illustrated schematically at FIGS. 4 and 5. FIG. 4 illustrates the normal mode in which received pixel color codes enable generation of a predetermined set of video output signals. FIG. 5 illustrates the operation of the color table load mode in which received pixel color codes are employed to load the color look up table.

FIG. 4 illustrates the normal operation of color palette 140. In accordance with the normal operation a scheme of pixel color codes is read out from pixel map memory 120 through the operation of display controller 110. These pixel color codes are represented schematically in FIG. 4 at 401, 402 and 403. In FIG. 4 we will consider the Nth pixel color code designated 402. In accordance with this example the pixel color code 402 comprises the binary digits "1010". This binary value corresponds to the decimal value 10 and therefore selects color register 10 from among the 16 color registers of color look up table 230. This function is illustrated schematically by the arrows from the pixel color code 402 to color register 10 of color look up table 230.

This color register 10 of color look up table 230 includes stored therein color data word 300. In accordance with the matter illustrated previously at FIG. 3, this color data word includes 2 attribute bits, 4 red color bits, 4 green color bits and 4 blue color bits. In this example the attribute bits are illustrated at 310, the red color bits are illustrated at 320, the green color bits are illustrated at 330 and the blue color bits are illustrated at 340. In accordance with the preferred embodiment of the present invention the red color bits 320, the green color bits 330 and the blue color bits 340 are all stored within color data buffer 240. Lines 242 transmits the red color bits 320 to red digital to analog converter 250. Red digital to analog converter 250 then generates an analog signal on red color line 142 in accordance with the digital value received from color data buffer 240. Similarly, lines 244 transmit green color bits 330 to the green digital to analog converter 260. The green digital to analog converter 260 then generates an analog signal on green color line 144 corresponding to the received digital value. Lastly, blue color bits 340 are transmitted via lines 246 to blue digital to analog converter 270 which generates a signal on blue color line 146 in accordance to the received digital value. Also in accordance with the preferred embodiment of the present invention, one or more of the attributes 310 are applied via line 233 to the enable input of color data buffer 240. This feature is provided to enable a repeat color operation which will be further described below.

In summary, the received pixel color codes from pixel map memory 120 each select one color register from color look up table 230 which then in turn specifies the exact red, green and blue color levels for application to the video display 150. This technique is a compromise between the use of a large amount of memory for pixel map memory 120 and the capability of providing a large number of colors. The pixel map memory stores only four bits per pixel. Using color look up table 230, each pixel color code can select one color data word which has one of $2^{12}$ or 4096 possible color combinations. Only 16 of these 4096 possible combinations can be accessed at one time, but by reloading the color—look up table these 16 selections can be varied.

FIG. 5 illustrates schematically the color look up table load operation of color palette 140. Stored within pixel map memory 120 are a plurality of color data words 501, 502, 503 and 504 which have color values G0 to G15. Upon application of the proper address signals to pixel memory map 120 via display controller 110, and the presentation of the proper mode control signals to color palette 140 via video timing and control circuit 115, these color data words are recalled from pixel map memory 120 and stored in sequential color registers within color look up table 230. FIG. 5 illustrates schematically the contents of the color data word 501 having the color value G0. Because pixel map memory 120 is organized in terms of pixel color codes, color data word 501 is shown as composed of four 4 pixel color codes 511, 512, 513 and 514. These correspond to pixels P0 to P3.

In accordance with the preferred embodiment of the present invention the attribute of each color data word comprises 2 bits and each red, green and blue color bits include 4 bits. This means that the complete color word stored within the color registers of color look up table 230 include 14 bits. Because the next nearest multiple of 4 bits, the size of the pixel color codes in the preferred embodiment, is 16, each of the color data values G0 to G15 comprises 16 bits. These 16 bits are organized as 4 successive pixel color codes. The first pixel color code P0 within each of these color data words includes data corresponding to the attribute. In this case, the 2 extra bits of pixel color code P0 which are not required to designate the attribute of the color data value are discarded. The remaining pixel color codes P1, P2 and P3 are employed to designate the respective red, green and blue color bits of the color data word. These four pixel color codes making up each color data word stored within pixel map memory 120 may be recalled one at a time. However, in accordance with the preferred embodiment in which display controller 110 and pixel map memory 120 operate on data words of 8 bits in length, the pixel color codes stored within pixel memory map 120 are recalled in pairs. This data is then applied to color look up table 230 for storage therein.

As illustrated schematically in FIG. 5, the first color data value G0 is stored within color register 0 of color look up table 230. Similarly, the second color data word G1 is stored within color register 1 of color look up table 230. In a similar fashion color word G9 is stored within color register 9 and color word G15 is stored within color register 15 of color look up table 230. During this operation control decode 210 causes addressor 235 to generate appropriate addresses for storage of the received data within the appropriate color register of color look up table 230. This serves to direct the stream of data received from pixel map memory 120 to the appropriate color register of color look up table 230.

The exact nature of the transfer of data from pixel map memory 120 to color look up table 230 is not crucial to the present invention. The key factor in the present invention is the enablement of a mode in which the color palette 140 receives a predetermined amount of data from pixel map memory 120 via the same data channel for receiving pixel color codes during normal operation. This stream of data is then loaded in a predetermined manner into the color registers of color look up table 230. This eliminates the need for a separate data channel for introduction of the data into the color registers of color look up table 230. An additional advantage of this technique is that it eliminates the need for a separate memory for storing the source data for loading color look up table 230. As a consequence of elimination of the requirement for this separate data and memory channel, the overall video display system 100 is simpler, less expensive to manufacture and easier to use.

In accordance with the present invention the color look up table load operation need not load the entire table. The size of the look up table of the preferred embodiment described in the present application is only 16 registers of 14 bits each. The time required to load this size of table is not very great. It is feasible to provide a color look up table having more registers, such as 256 registers which correspond to pixel color codes of 8 bits. It is also feasible to provide registers having more than 14 bits. In such an event the loading of the entire color look table would take a considerable period and reduce the time available for updating the display. In such a case it would be advantageous to provide a means to load only a selected portion of the color look up table. A set of 256 color registers could be divided into 8 banks of 32 registers each, with the capability of loading only the 32 registers of a single bank. This technique is particularly valuable in the mode, described below, in which a color load operation takes place for each video line.

FIGS. 6 to 11 illustrate the preferred embodiment of the manner of application of the mode signals to control decode circuit 210. In accordance with the preferred embodiment, the color table load operation occurs in three differing modes. In the first mode, color look up table 230 is loaded upon beginning each video frame. In a second mode, color look up table 230 is loaded at the beginning of selected frames only. Lastly, in the third mode of the preferred embodiment, color look up table 230 is located at the beginning of each video line. The mode signals selected for control of control decode circuit 210, and illustrated in FIG. 6, 8 and 10, have been selected because they are signals readily available to a video system and are required to be generated by video timing and control circuit 115 for other video control functions. Therefore, color palette 140 does not require the generation of additional types of control signals, thus saving equipment and expense required to operate this device.

Figure 6:
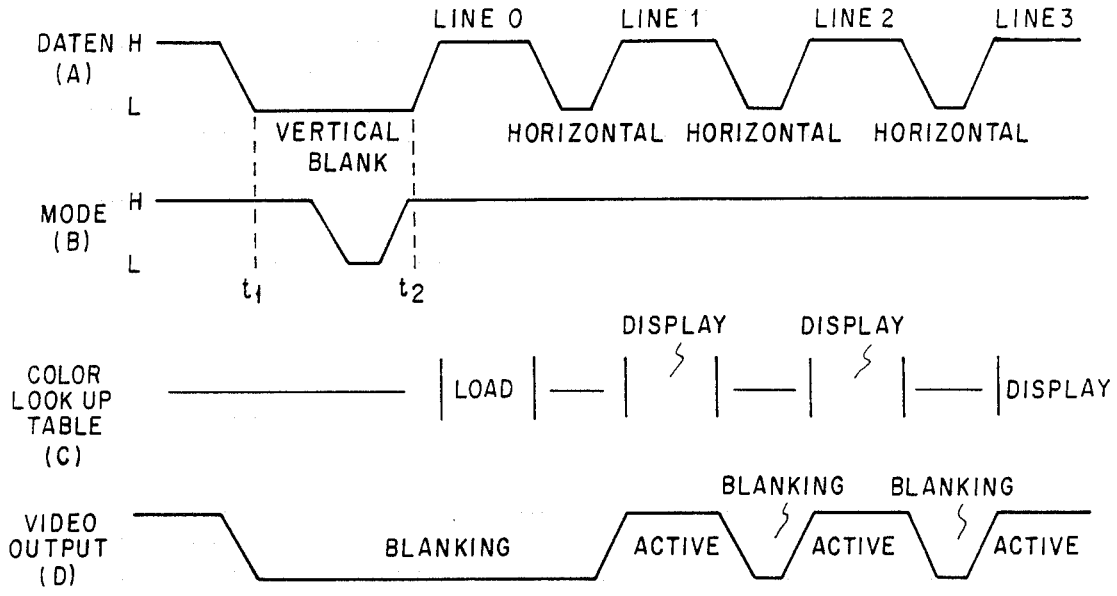
FIG. 6 illustrates various signals in accordance with one manner of employing the color look up table load mode once per frame in accordance with a first embodiment of the present invention.

FIG. 6 illustrates the various signals involved in the operation of color palette 140 in a mode in which color look up table 230 is loaded once per frame. The data enable signal (DATEN) transmitted to control decode circuit 210 on line 212 is illustrated at FIG. 6(*a*). The data enable signal indicates to control decode circuit 210 when valid data is being transmitted via bus 135. For clarity, portions of the data enable signal illustrated in FIG. 6(*a*) have been labeled line 0, line 1, line 2 and line 3 to indicate the coincidence between these portions of the data enable signal and lines of the video display 150. The extended low interval in the DATEN signal marks the vertical blanking period. The beginning of the vertical blanking period is at time $t_1$ and the end of the vertical blanking period is at time $t_2$. The required MODE signal to trigger the loading of color look up table 230 once per frame is illustrated in FIG. 6(*b*). Notice that this MODE signal includes a single low pulse during the vertical blanking period prior to line 0.

Control decode circuit 210 receives the DATEN and MODE signals illustrated above and provides the functions noted below in FIGS. 6(*c*) and 6(*d*). The DATEN signal is used to define the vertical blanking period from $t_1$ to $t_2$. The MODE signal is monitored during this interval. If the MODE signal is low during an portion of this interval and high at the time $t_2$ at the end of the vertical blanking period, then the color look up table is loaded during the next video line and that entire line is blanked. The remainder of the lines of that frame display in the normal mode. As illustrated in FIG. 6(*c*) the color look up table is loaded during line 0, and provides display during lines 1, 2 and 3. It should be noted that the color look up table continues to provide display during each of the succeeding lines until the beginning of the next frame as indicated by the extended low pulse on the DATEN signal. FIG. 6(*d*) illustrates the state of the video output, which in the preferred embodiment is respective red, green and blue outputs. During the interval from the beginning of the low signal of the DATEN line until the beginning of the active portion of line 1, the respective red, green and blue signals are at a blanking level. Thus the output of color palette 140 causes video display 150 to be blanked during the entire line 0, the line during which the color line look up table is loaded. During the active portions of lines 1, 2 and 3 the respective red, green and blue signals are active. As noted in FIG. 6(*d*) these red, blue and green signals are at a blanking level during the interval between the active portions of lines 1 and 2, and lines 2 and 3.

Figure 7:
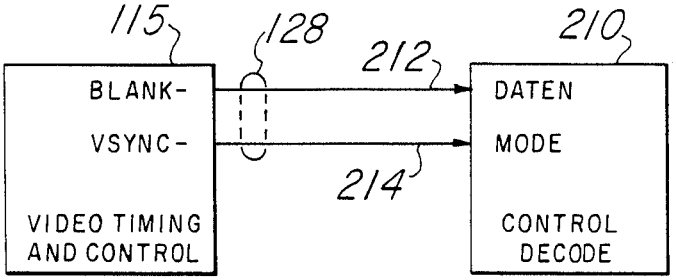
FIG. 7 illustrates the proposed connections between the video timing and control circuit and the control decode circuit in accordance with the present invention.

FIG. 7 illustrates the manner of providing the DATEN and MODE signals required to cause the color palette 140 to mode the color look up table once at the beginning of each frame. As illustrated in FIG. 7 the DATEN line 212 of control decode circuit 210 is connected to a BLANK- output of video timing and control circuit 115. This BLANK- output is the inverse of the video blanking signal. This video blanking signal indicates when the video of video display 150 is to be turned off or blank. Such a signal must be generated by video timing and control circuit 115 for control of video display 150. It is therefore most convenient to apply this signal to the DATEN input of control decode circuit 210. As noted above, the DATEN signal indicates to color palette 140 when valid data is supplied via bus 135.

Similarly, the MODE input signal on line 214 to control decode circuit 210 is the VSYNC- signal. This is the inverse of the vertical sync signal which must be generated by video timing and control circuit 115 for proper control of video display 150. This signal occurs during the vertical blanking period just as illustrated in FIG. 6(*b*).

Figure 8:
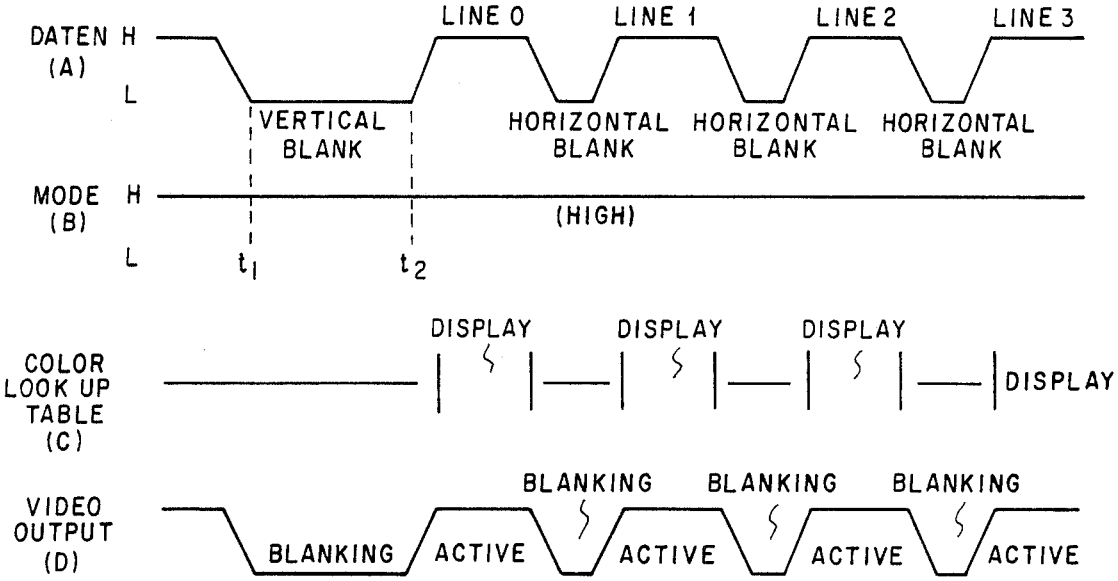
FIG. 8 illustrates various signal and timing functions during a frame not having a color look up table load operation in accordance with a second embodiment of the present invention.

FIG. 8 illustrates the signals and operation during the beginning of a video frame in which the color look up table in not loaded. In accordance with a second preferred embodiment of the present invention, the color look up table is loaded at the beginning of only selected video frames. In the event that the particular video frame is not selected the signals are illustrated in FIG. 8. FIG. 8(*a*) illustrates the DATEN signal which is similar to the DATEN signal illustrated in FIG. 6(*a*). This includes a designation of the active portion of line 0, line 1, line 2 and line 3 for clarity. Contrary to that illustrated in FIG. 6(*b*), FIG. 8(*b*) illustrates the MODE signal retained at the high level. Because the MODE signal is retained at a high level throughout the vertical blanking period between times $t_1$ and $t_2$ prior to video line 0, the color look up table 230 of color palette 140 is not loaded. As illustrated in FIG. 8(*c*) the color look up table is in display mode during line 0, line 1, line 2 and line 3. In addition, the respective red, green and blue color signals are active during the respective lines and are blanking during the periods between the respective lines as illustrated in FIG. 8(*d*).

Figure 9:
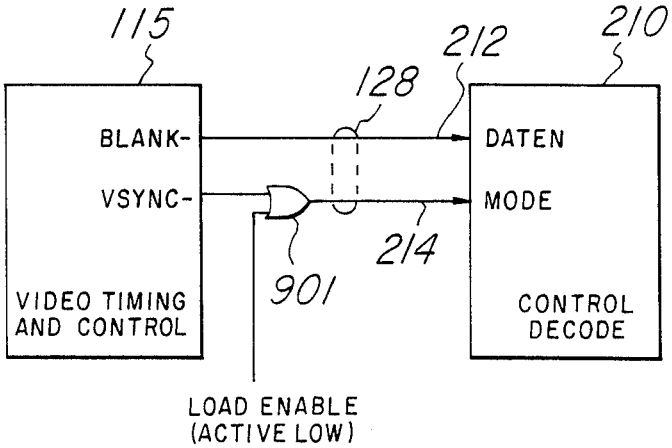
FIG. 9 illustrates the connections from the video timing and control circuit to the control decode circuit in accordance with an embodiment of the present invention in which the color table is loaded on selected frames.

FIG. 9 illustrates the circuit for connecting video timing and control circuit 115 to control decode circuit 210 in accordance with this second preferred embodiment of the present invention. As illustrated previously in FIG. 7, the DATEN signal applied to control decode 210 on line 212 is the BLANK- signal derived from video timing and control circuit 115.

The circuit illustrated in FIG. 9 further includes OR gate 901. One input of OR gate 901 is the VSYNC-signal from video timing and control circuit 115. This is the same inverted vertical sync signal illustrated in FIG. 7. Connected to the other input of OR gate 901 is a load enable signal which has an active low level. The output of OR gate 901 is coupled via line 214 to the mode input of control decode 210. In the event that the load enable signal is high, then the mode input of control decode circuit 210 receives a constant high signal, such as illustrated in FIG. 8(*b*). In ths event the color look up table is not loaded and the contents of color registers 0 through 15 are unchanged. If, on the other hand, the load enable signal is low then the VSYNC- signal is passed through gate 901 unaltered. In this event the situation is as illustrated in FIG. 6. The mode signal illustrated in FIG. 6(*b*) has a low pulse during the vertical blanking period of the DATEN signal illustrated in FIG. 6(*a*). In this event the color look up table loaded during line 0 and the red, green and blue signals are at blanking level and to the start of line 1.

Figure 10:
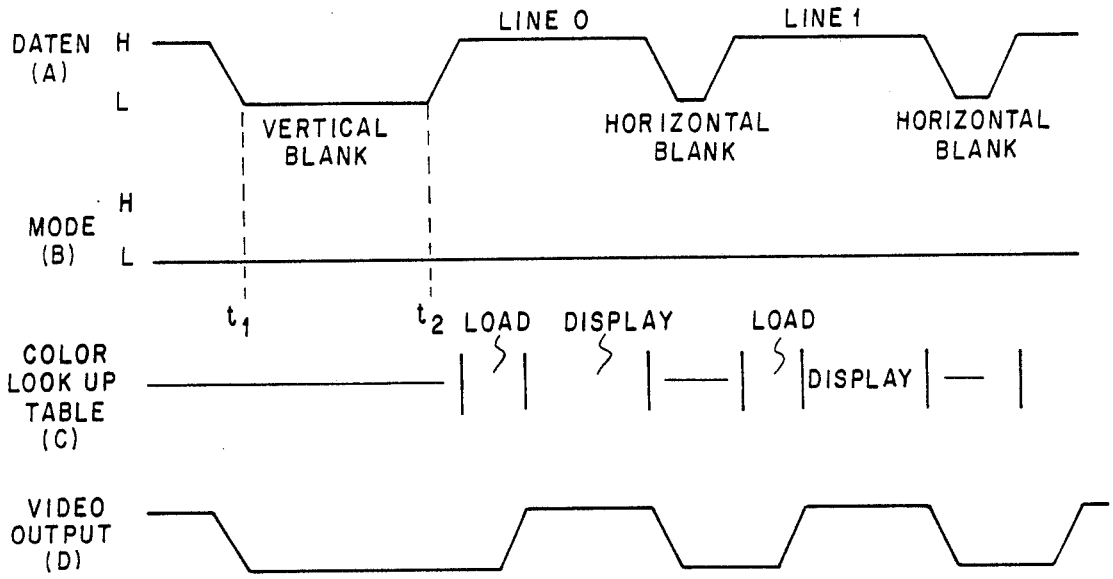
FIG. 10 illustrates various signals in accordance with the mode of the present invention in which the color table is loaded on every line.

FIG. 10 illustrates the timing signals and operations during a third preferred embodiment of the present invention. In this third preferred embodiment of the present invention the color look up table is loaded at the beginning of each horizontal line of the video display 150. The DATEN signal is illustrated in FIG. 10(*a*) and is substantially as illustrated in FIGS. 6(*a*) and 8(*a*), except that the time scale has been expanded for ease of indication of the operation. Illustrated schematically is the active periods of line 0 and line 1. FIG. 10(*b*) illustrate the MODE signal which is at a constant low level. As in the previous cases illustrated if FIGS. 6 and 8, the MODE signal is monitored during the vertical blanking period between times $t_1$ and $t_2$. In this case the MODE signal is low during some of the interval between times $t_1$ and $t_2$ and is low during time $t_2$. This signals the third mode to control decode 210.

The operation of color look up table 230 is illustrated schematically in FIG. 10(*c*). During the first portion of both line 0 and line 1 the color look up table is loaded. During the latter portion of each of these lines normal display takes place. Assuming that the data stream applied to color palette 140 is the same rate during color table load as during normal display, the color table load operation takes the same amount of time as the generation of 64 pixels. This is because each of the 16 color registers require 4 pixels for loading, totaling 64 pixel periods. A typical video display such as video display 150 would include several hundred pixels on each horizontal line. Therefore, the length of time required for the color load operation would only be a fraction of the length of time required to display an entire horizontal line.

FIG. 10(*d*) illustrates the operation of the red, green and blue color signals during this third preferred embodiment of the present invention. Notice that the blanking interval of the red, green and blue color signals is extended into the active line portions of the data enable signal during the color load operation. This extra blanking interval occurs because control decode 210 enters the third mode in response to the constant low level of the MODE signal. Because of this difference in the MODE signal, the particular line is blanked only during the predetermined color look up table load interval and not during the entire line as illustrated in FIG. 6.

Figure 11:
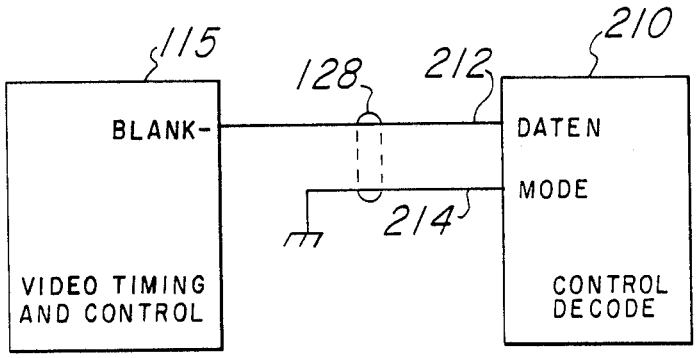
FIG. 11 illustrates the connections between the video timing and control circuit and the control decode circuit in accordance with a third embodiment of the present invention in which the color look up table is loaded on every line.

FIG. 11 illustrates a circuit for providing the signals illustrated in FIG. 10. This circuit enables the third preferred embodiment of the present invention in which the color look up table is loaded at the beginning of each horizontal line. As before the BLANK- signal from video timing and control circuit 115 is applied to the DATEN input of control decode circuit 210 via line 212. In this case, both the MODE signal input is tied to ground reference. This assures that the MODE signal has the constant low level illustrated in FIG. 10(*b*).

A further aspect of the color palette 140 illustrated in FIG. 2 is the possibility of providing a repeat color within one more of the color registers of color look up table 230. Referring again to FIG. 2 it should be noted that a line 233 couples some of the bits from color look up table 230 to an enable input of color data buffer 240. In accordance with the preferred embodiment of the present invention, one of the attribute bits of the color data word of the selected color register is applied to the enable input of color data buffer 240 via line 233. When this bit is in the first state, the normal state, color data buffer 240 is enabled. Therefore, the respective red, green and blue color bits of the selected color register are stored in color data buffer 240. They are therefore applied to respective red digital to analog converter 250, green digital to analog converter 260 and blue digital to analog converter 270. In the repeat case, this bit of the attribute of the color data word is in the opposite state. In such an event input to the color data buffer 240 is not enabled. Therefore the data stored within the selected color register is not loaded into color data buffer 240. The contents of color data buffer 240 remain as previously specified.

Figures 14, 15:
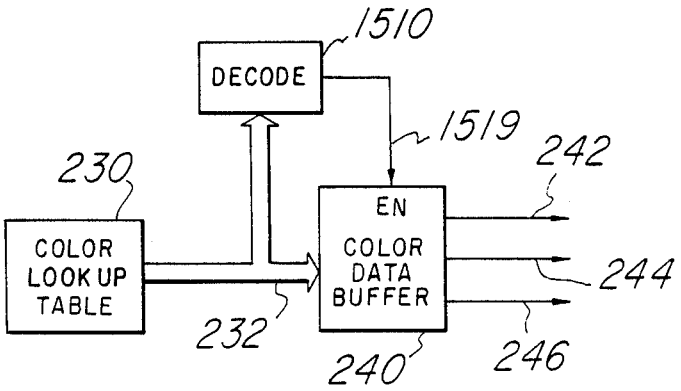
FIG. 14 illustrates the equivalent color codes generated by the color palette of the present invention when the pixel memory map contains repeat and non-repeat color codes as illustrated in FIG. 13.
FIG. 15 illustrated an alternative embodiment of implementing the repeat color operation in accordance with the present invention.

This possibility of selecting a color from color look up table 230 which repeats the previous color is advantageous in enabling the drawing of figures by manipulation of the pixel color codes stored within pixel map memory 120. FIGS. 12, 13 and 14 illustrate schematically one advantageous manner in which this repeat color can be employed. FIG. 12 illustrates a portion of pixel map memory 120. Each cell within FIG. 12 represents the memory location at which a single pixel color code is stored. In FIG. 12 each of these cells contains an R. This R indicates that the pixel color codes stored within each of these memory locations selects a repeat color from color look up table 230. That is, the pixel color code stored within each of these cells selects a color register within color look up table 230 which has an attribute indicating a repeat color. In this event, the color stored within color data buffer 240 is unchanged and therefore the color of the display is unchanged.

FIG. 13 illustrates the condition of the same portion of pixel map memory 120 as illustrated in FIG. 12, after a slight change in the pixel color codes stored therein. Display controller 110 stores the pixel color codes referenced by the numerals 1, 2 and 3 illustrated in FIG. 13. Note that these pixel color codes stored within pixel map memory 120 do not include every element within this portion illustrated. On the contrary, only a few of the memory locations have been altered. These new pixel color codes are located in the leftmost edges of each region. This leftmost edge corresponds to the first edge to be scanned in accordance with the normal process of scan from left to right. These pixel color codes entered within pixel map memory 120 together with the previously entered repeat color codes cause the entire display to be determined.

FIG. 14 illustrates the effect of the combination of the newly entered pixel color codes illustrated in FIG. 13 and the previously stored repeat color codes. In each horizontal line of FIG. 14 the initial pixel color code 1 recalls from the color look up table 230 the corresponding color data from the selected color register. This color data remains within color data buffer 240, even after additional pixel color codes are recalled because these additional pixel color codes are initially the repeat color code. Only when a further pixel color codes which is not a repeat pixel color code is encountered does the data stored within color data buffer 240 change. Thus for example a single line of display can have a number of colors over a number of differing regions while display controller 110 need only enter the pixel color codes for the edges of these regions. Because the entry of data into large regions of the pixel map memory 120 requires considerable memory transfer and therefore large amounts of time, this technique is advantageous because it enables the specification of the entire screen color by writing into only the edges of regions within pixel map memory 120. Naturally writing only upon the edges of these regions requires much fewer pixel color codes and hence a much shorter time to achieve a complete specification of the desired display. As a consequence, the video system illustrated in FIG. 100 can be altered at a more rapid rate than prior to the present invention.

The repeat color data word is also useful for hidden objects. If an object is stored in the pixel map memory having a pixel color code corresponding to a repeat color data word, then this object can be made to appear and disappear by changing only the color look up table. By changing the color look up table to alter the particular color data word stored in that particular color register, then the color can be made to repeat the previous color or have a new color of its own. Simple animation can be achieved by this means by sequentially changing the color registers which correspond to several pixel color codes from repeat to nonrepeat color data words. This technique is advantageous because much less data needs to be processed to change the display in this manner than is required to write new pixel color codes into the pixel map memory. A cruder form of this animation is possible using the prior art by changing a color data word from a background color to a new color. This process is better using the present invention because the background may have more than one color when a repeat color data word is used for the object.

FIG. 15 illustrates an alternative embodiment of the connection between the color look up table 230 and the color data buffer 240. In this case the entire color data word recalled from color look up table 230 is coupled to decode circuit 1510. This connection is in addition to the connection to color data buffer 240. Based upon a comparison of the actual color data word with a predetermined repeat color data word, decode circuit 1510 generates an enable signal via line 1515 to the enable input of color data buffer 240. If the recalled color data word is not the predetermined repeat color, then color data buffer 240 is enabled. In that case the recalled color data word is stored in color data buffer 240 and controls the video signals transmitted to video display 150. If the recalled color data word is the predetermined repeat color data word, then the loading of color data buffer 240 is disabled. Thus the contents of the color buffer are unchanged and a repeat color function is performed.

We claim:

1. A color palette system comprising:

a controller having a data port;

a pixel map memory having a data port coupled to said controller data port and a data output, said pixel map memory having a plurality of pixel color codes defining a visual image, each pixel color code stored at a memory location corresponding to a video screen location;

a memory controller connected to said pixel map memory for sequentially applying memory addresses to said pixel map memory for recalling pixel color codes from said pixel map memory at said data output in a predetermined order corresponding to the raster scan of a video screen;

a switch having an input connected to said pixel map memory data output and having first and second outputs;

a color look up table having a first input connected to said switch first output for addressing said color look up table and having a second input connected to said switch second output for supplying data to be stored in said color look up table, said color look up table receiving said recalled pixel color codes at said first input, and said color look up table having a plurality of color registers having stored therein color data words;

a video signal generator connected to said color look up table for generating a video output signal having color characteristics corresponding to color data words recalled from said color registers; and a mode control device connected to said color look up table and responsive to at least one mode control signal for causing said color look up table to operate in one of a normal mode and a color look up table load mode wherein each pixel color code received from said pixel map memory selects one of said color registers for recall of one of said color data words stored therein for transmission to said video signal generator during said normal mode and wherein a predetermined sequence of pixel color codes recalled from said pixel map memory at said data output are presented to said color look up table at said second input thereof and stored in said color registers thereby loading said color data words into said color registers during said color look up table load mode.

2. A color palette system as claimed in claim 1, further comprising:

a visual display means connected to said video signal generator for generating a visually perceivable representation of said said visual image in accordance with said at least one video output signal.

3. A color palette system as claimed in claim 1, wherein:

said memory controller is further connected to said pixel map memory for storing therein said plurality of pixel color codes defining said visual image and pixel color codes corresponding to said color data words to be loaded into said color look up table.

4. A color palette system as claimed in claim 1, wherein:

said video signal generator generates separately a red color signal, a green color signal and a blue color signal.

5. A color palette system as claimed in claim 4, wherein:

each of said color data words includes a plurality of bits, a first subset thereof being red color bits, a second subset thereof being green color bits and a third subset thereof being blue color bits; and said video generator generates said red color signal corresponding to said red color bits of said received color data word, said green color signal corresponding to said green color bits of said received color data word, and said blue color signal corresponding to said blue color bits of said received color data word.

6. A color palette system as claimed in claim 1, wherein:

said mode control device is responsive to a first state of said at least one mode control signal to enter said color look up table load mode and thereby load color look up table prior to each frame of said visual image.

7. A color palette system as claimed in claim 6, wherein:

said mode control device is further connected to said video signal generator for entering said color look up table load mode and controlling said video generator to generate said at least one video output signal at a blanking state for an initial video line of each video frame and entering said normal mode and controlling said video signal generator to generate said at least one video output signal corresponding to said recalled color data words for the remaining video lines of each video frame in response to said first state of said at least one mode control signal.

8. A color palette system as claimed in claim 1, wherein:

said mode control device is responsive to a second state of said at least one mode control signal to enter said color look up table load mode and thereby load said color look up table prior to selected frames of said visual image.

9. A color palette system as claimed in claim 8, wherein:

said mode control device is further connected to said video signal generator for entering said color look up table load mode and controlling said video generator to generate said at least one video output signal at a blanking state for an initial video line of each selected video frame and entering said normal mode and controlling said video signal generator to generate said at least one video output signal corresponding to said recalled color data words for the remaining video lines of each selected video frame and for entering said normal mode and controlling said video signal generator to generate said at least one video output signal corresponding to said recalled color data words for all of the video lines of each nonselected video frame in response to said second state of said at least one mode control signal.

10. A color palette system as claimed in claim 1, wherein:

said mode control device is responsive to a third state of said at least one mode control signal to enter said color look up table load mode and thereby load said color look up table prior to each line of said visual image.

11. A color palette system as claimed in claim 10, wherein:

said mode control device is further connected to said video signal generator for entering said color look up table load mode and controlling said video generator to generate said at least one video output signal at a blanking state for an initial color look up table load interval of each video line and entering said normal mode and controlling said video signal generator to generate said at least one video output signal corresponding to said recalled color data words for the remaining period of each video line in response to said third state of said at least one mode control signal.

12. A color palette comprising:

a pixel map memory for supplying sequences of pixel color codes:

a switch having an input connected to said pixel map memory and having first and second outputs;

a color look up table having a first input connected to said switch first output for addressing said color look up table and having a second input connected to said switch second output for supplying data to be stored in said color look up table, said color look up table receiving said pixel color codes at said first input thereof, and said color look up table having a plurality of color registers having color data words stored therein; and a mode control device connected to said color look up table and responsive to mode control signals for causing said color look up table to operate in one of a normal mode and a color look up table load mode wherein each pixel color code received from said pixel map memory selects one of said color registers for recall of one of said color data words stored therein during said normal mode and wherein a predetermined sequence of pixel color codes received from said pixel map memory are presented to said color look up table at said second input thereof and stored in said color registers thereby loading said color data words into said color registers during said color look up table load mode.

13. A color palette as claimed in claim 12, further comprising:

a video signal generator connected to said color look up table for generating at least one video output signal having color characteristics corresponding to color data words recalled from said color registers when said color look up table operates in said normal mode.

14. A color palette as claimed in claim 13, wherein:

said at least one video output signal generated by said video signal generator includes a red color signal, a green color signal and a blue color signal.

15. A color palette as claimed in claim 14, wherein:

each of said color data words includes a plurality of bits, a first subset thereof being red color bits, a second subset thereof being green color bits and a third subset thereof being blue color bits; and said video generator generates said red color signal corresponding to said red color bits of said received color data word, said green color signal corresponding to said green color bits of said received color data word, and said blue color signal corresponding to said blue color bits of said received color data word.

16. A color palette as claimed in claim 12, wherein:

said mode control device is responsive to a first state of mode control signals to enter said color look up table load mode and thereby load said color look up table prior to each frame of said visual image.

17. A color palette as claimed in claim 12, wherein:

said mode control device is responsive to a second state of mode control signals to enter said color look up table load mode and thereby load said color look up table prior to selected frames of said visual image.

18. A color palette as claimed in claim 12, wherein:

said mode control device is responsive to a third state of mode control signals to enter said color look up table load mode and thereby load said color look up table prior to each line of said visual image.

19. A color palette as claimed in claim 12, wherein:

said mode control device receives a first digital mode control signal corresponding to the inverse of a video blanking signal and a second digital mode control signal, said mode control device sampling said second digital mode control signal during a vertical blanking period identified from the first digital mode control signal, wherein said mode control device remains in said normal mode throughout a video frame if said second digital mode control signal is at a first digital state during the entire vertical blanking period, said mode control device enters said color look up table load mode during a first line of said video frame and enters said normal mode for the remaining video lines of said video frame if said second mode control signal is at the first digital state and briefly at a second digital state during a part of said vertical blanking period, and said mode control device enters said color look up table load mode for a predetermined period of time at the beginning of every video line of said video frame and enters said normal mode for the remainder of every line of said video frame if said second mode control signal is at the second digital state during the entire vertical blanking period.

20. A color palette as claimed in claim 19, wherein:

said first digital state of said second digital mode control signal is a uniformly high level and said second digital state of said second digital mode control signal is a uniformly low level.

21. A color palette as claimed in claim 12, wherein:

said mode control device receives a first digital mode control signal corresponding to the inverse of a video blanking signal and a second digital mode control signal, said mode control device sampling said second digital mode control signal during a vertical blanking period identified from the first digital mode control signal, wherein said mode control device remains in said normal mode throughout a video frame if said second digital mode control signal is at a first digital state during the entire vertical blanking period, said mode control device enters said color look up table load mode during a first line of said video frame and controls said video signal generator to generate said at least one video output signal at a blanking state for said first line of said video frame, and enters said normal mode for the remaining video lines of said video frame if said second mode control signal is at the first digital state and briefly at a second digital state during a part of said vertical blanking period, and said mode control device enters said color look up table load mode for a predetermined period of time at the beginning of every video line of said video frame and controls said video signal generator to generate said at least one video output signal at said blanking state for only said predetermined period of time at the beginning of each video line, and enters said normal mode for the remainder of every line of said video frame if said second mode control signal is at the second digital state during the entire vertical blanking period.

22. A color palette as claimed in claim 12, wherein:

said mode control device causes said color look up table to operate in said color look up table load mode permitting loading of a predetermined set of less than all of said color registers of said color look up table.

* * * * *